US010442662B2

(12) United States Patent
Husmann

(10) Patent No.: US 10,442,662 B2
(45) Date of Patent: Oct. 15, 2019

(54) CALIPER BRAKE FOR ELEVATOR SYSTEMS

(71) Applicant: Inventio AG, Hergiswil (CH)

(72) Inventor: Josef Husmann, Lucerne (CH)

(73) Assignee: INVENTIO AG, Hergiswil (CH)

( * ) Notice: Subject to any disclaimer, the term of this patent is extended or adjusted under 35 U.S.C. 154(b) by 525 days.

(21) Appl. No.: 15/104,591

(22) PCT Filed: Nov. 7, 2014

(86) PCT No.: PCT/EP2014/074049
§ 371 (c)(1),
(2) Date: Jun. 15, 2016

(87) PCT Pub. No.: WO2015/090726
PCT Pub. Date: Jun. 25, 2015

(65) Prior Publication Data

US 2016/0355377 A1 Dec. 8, 2016

(30) Foreign Application Priority Data

Dec. 19, 2013 (EP) ..... 13198295

(51) Int. Cl.
*B66B 5/18* (2006.01)

(52) U.S. Cl.
CPC ..... *B66B 5/18* (2013.01)

(58) Field of Classification Search
CPC ..... B66B 5/18
See application file for complete search history.

(56) References Cited

U.S. PATENT DOCUMENTS

| | | | | | |
|---|---|---|---|---|---|
| 5,819,879 | A * | 10/1998 | Lang | B66B 5/18 187/376 |
| 7,604,099 | B2 * | 10/2009 | Kigawa | B66B 5/18 187/288 |
| 9,145,282 | B2 * | 9/2015 | Schautt | B66B 5/18 |
| 9,511,977 | B2 * | 12/2016 | Schautt | B66B 5/24 |
| 2017/0036888 | A1 * | 2/2017 | Ladner | B66B 1/365 |

FOREIGN PATENT DOCUMENTS

| | | | | |
|---|---|---|---|---|
| CH | 684190 | A5 | 7/1994 | |
| CN | 1279208 | A | 1/2001 | |
| CN | 2783036 | Y | 5/2006 | |
| CN | 201896887 | U | 7/2011 | |
| CN | 103144647 | A | 6/2013 | |
| DE | 202004017585 | U1 | 1/2005 | |
| DE | 102011000720 | A1 | 8/2012 | |
| EP | 1067084 | A1 | 1/2001 | |
| EP | 1460021 | A1 * | 9/2004 | B66B 11/028 |
| EP | 1657204 | A2 | 5/2006 | |
| JP | 2009046246 | A * | 3/2009 | |
| WO | 2012080102 | A1 | 6/2012 | |
| WO | WO-2018130520 | A1 * | 7/2018 | B66B 17/34 |

* cited by examiner

*Primary Examiner* — Diem M Tran
(74) *Attorney, Agent, or Firm* — William J. Clemens; Shumaker, Loop & Kendrick, LLP

(57) ABSTRACT

A caliper brake for elevator systems has at least one, and preferably two, brake calipers. Each brake caliper has at least one brake pad on a respective brake arm pivoted at a fulcrum. The brake caliper can be swiveled at least into a ready position and into a braking position. The brake arm is elastic and preferably embodied at least partly as a leaf spring.

21 Claims, 4 Drawing Sheets

CALIPER BRAKE FOR ELEVATOR SYSTEMS

FIELD

The present invention relates to a caliper brake for elevator systems, a method for generating a press-on-force in a caliper brake, and an elevator system with a caliper brake.

BACKGROUND

Known from the prior art are various devices which serve in an elevator system as safety brakes. Safety brakes of various types, as, for example, wedge safety gear, eccentric brakes, or also caliper brakes, are known.

From EP 1657204 A2 a caliper brake for an elevator system has become known which, through a toggle lever, transfers the force of a spring accumulator to brake calipers. Disadvantageous in this caliper brake is, for example, the fact that the spring accumulator is loaded during the entire braking process. Depending on the accuracy of the guiderail onto which the caliper brake grips, there is the danger of the spring accumulator being loaded with a varying force. In the worst case, a fluttering or vibration of the brake calipers is possible. This can cause fatigue fractures in the spring accumulator or in individual turns of a spring.

SUMMARY

It is an object of the invention to overcome the disadvantages of the prior art. In particular, a caliper brake, a method of generating a press-on force in a caliper brake, and an elevator system with a caliper brake of this type shall be made available, which offers a high degree of safety, is protected against fatigue fractures, and, in addition, requires smaller forces to trigger the actuating mechanism. Further, a mechanism for actuating such a caliper brake shall be presented.

A caliper brake for elevator systems according to the invention contains at least one, and preferably two, brake calipers. Each brake caliper has at least a brake pad, a brake arm, and a fulcrum. At least one brake caliper is swivelable at least into a ready position and into a brake position. The brake arm is elastic and preferably embodied at least partly as a leaf spring.

The brake arm is embodied in such manner that the brake arm extends from the fulcrum in the direction opposite to the brake pad. In consequence, the brake caliper has a construction in the sequence of brake pad, fulcrum, and brake arm.

The braking position is the position that is assumed by the components during the braking process. In consequence, when used according to the invention, in the braking position the brake pads are in mechanical engagement with, for example, a guiderail, or a web of the guiderail, of an elevator.

The brake calipers have an essentially longitudinal extent, the brake pad being arranged at the end of the brake caliper. The fulcrum is situated between the brake pad and the brake arm, the brake arm being embodied at its end in such manner that it can, for example, be connected with a force accumulator and a toggle lever. In the braking position, the ends of the brake arms can only assume a predefined position in which, during the braking operation, they remain in a stable position. In association with the spring properties of the brake arms, a press-on force of the brake pads on the guiderails, and the brake force resulting therefrom, is independent of an actual braking force.

Such an embodiment of the brake caliper is advantageous, because, during the braking procedure, the ends of the brake arms, or the input point of a force that acts on the brake arms, remains constantly in the same position. Such an embodiment is inexpensive, because the brake arms that are present in any case can be used directly as springs.

Preferably, the brake arm is made of a high-strength material which can sustain stresses that are as high as possible. This can be, for example, a high-quality cast steel, preferably a tempered spheroidal cast iron, or a spring steel.

Preferably, the brake pad, the brake arm, and the fulcrum are arranged relative to each other in such manner that, between the end of the brake arm and the fulcrum, as well as between the fulcrum and the brake pad, a length ratio of at least 1:2, preferably of at least 1:3, and particularly preferably of at least 1:4, can be set. This corresponds to a consequential force ratio of the same magnitude.

Preferably, the caliper brake is embodied in such manner that a predefined press-on force of the brake calipers can be generated through deformation of the brake arms by a predefined distance in a direction perpendicular to the brake arms. The deformation play can be up to 10%, preferably up to 7.5%, and particularly preferably up to 5%, of the length of the brake arm. Preferably, the aforesaid deformation distance is so dimensioned that, when set to a minimum load, the brake arm is still deformed by at least 2% of its length perpendicular to its length. One form of the brake arm is preferably embodied in such manner that a thickness of the arm in the direction of a spreading force, or in the direction of the press-on force, in relation to the height of the arm, is small, preferably in a ratio of less than 1:4. Starting from the fulcrum, the thickness of the brake arm can diminish in the direction of the end of the brake arm on which the toggle levers are arranged, so that, during spreading, a material stress occurs which remains essentially constant.

Hence, the press-on force is defined by the springing of the brake arm. A certain elasticity of individual components, which directly or indirectly interact with the brake calipers, is, by comparison with the springing, negligible, and has no effect on the press-on force. This is, in particular, achieved through a minimal initial springing, so that also a possible slight brake-plate wear can be compensated. The brake plates are preferably made of hardened material, so that a hardness of the brake plate is at least greater than the hardness of the guiderail with which the brake plate interacts for the purpose of braking.

For a lever with a length of approximately 160 mm, which, during the braking process, is deformed by approximately 8 mm, (which represent approximately 5% of the length of the brake arm), and whose brake pad, brake arm, and fulcrum are arranged in a length ratio of approximately 1:4, a force on the input point of the brake arm of around 6.25 kN is sufficient to generate on the brake pads a press-on force of approximately 25 kN, when the spring constant of the brake arm amounts to approximately 800 N/mm. Self-evidently, the dimensions depend on the desired application range of the brake. The dimensions, dimensional ratios, and length ratios can therefore be adapted and changed.

The caliper brake can be embodied in such manner that each brake caliper is in mechanical engagement with a brake housing. The press-on force can be adjustable by mechanical means, in particular adjustment screws. Preferably, the adjustment screws are situated at an end of the brake caliper that faces away from the brake pad. Preferably, the amount of the deformation is adjustable and, particularly preferably, through adjustment of an air gap. The air gap is a free gap between brake pad and guiderail in the ready position of the caliper brake. The adjustment screws can be located at the input point of the force, in particular, the input point of the force relative to the brake arm is adjustable by means of the adjustment screws. By this means, the deflection or deformation of the brake arms is adjustable. If a small braking force is required, the air gap is set to a large dimension, so that the remaining spring loading of the brake arm is small.

This allows the manufacture of brake calipers with relatively high tolerances and for a relatively large application range. Through adjusting screws, for example, such manufacturing tolerances can be compensated. In addition, adjustment of the caliper brake to different press-on forces is possible.

Alternatively, it is also conceivable to move the fulcrum relative to the brake housing. For example, an eccentric axis can be provided, which displaces the fulcrum. An elongated aperture in the brake arm is also conceivable, in this case, however, the brake housing is also movably borne or is adjustable.

A further aspect of the invention relates to a caliper brake for elevator devices with at least one, and preferably two, brake calipers, preferably brake calipers as here described. With toggle levers, the brake calipers can be brought out of a ready position into a braking position. In the braking position, the toggle levers occupy a position behind their dead point. This position is defined by a stop. A dead point is a position of the toggle lever which is embodied in such manner that the toggle lever is self-locking.

This is of particular advantage since, during the braking process, the brake calipers can only adopt one single precisely defined brake position, which is defined through the geometry of the toggle lever. In the braking position, the points of the brake calipers at which the toggle levers grasp the brake calipers are always in the same position. To arrive at the braking position, the knee of the toggle lever is brought, for example, by an actuating mechanism, into a position in which all toggle-lever points lie in one working axis. This unstable point is the dead point of the system. Subsequently, the toggle lever is moved further in the same direction of movement until the knee of the toggle lever is in an inverted position relative to the original position, in other words, the toggle lever is beyond its dead point. Through a position of the toggle lever which is beyond its dead-point position, a mechanism that moves the toggle lever is no longer loaded by a dynamic force.

Preferably, the toggle levers have a force-input point which is in mechanical engagement with a force accumulator, in particular with a spring assembly. The position of the toggle lever is preferably defined by the force accumulator and the stop.

As here described, such a position of the toggle lever is advantageous, because, in consequence, dynamic forces are transferred to a stop.

Preferably, the force accumulator has a piston and a stop, wherein the stop limits the stroke of the piston. Preferably, this stop directly forms the stop for the toggle lever. In particular, the force accumulator can have a stop buffer, so that a force impulse upon impact of the piston on the stop is reduced. Such a force accumulator is disclosed in, for example, WO 2013/092239 A1.

A force accumulator of this type has the advantage that the forces in the spring accumulator are reduced if the spring accumulator or brake device is triggered inadvertently, or for maintenance purposes, as long as it is in the uninstalled state without, for example, a guiderail between the brake pads.

Each of the brake calipers can have a separate toggle lever, which are preferably mutually linked.

The toggle levers can at one end be fastened to the brake calipers, or be in mechanical engagement therewith, at the other end be in mutual mechanical engagement with their other ends. A single input point, which mutually links the two toggle levers, is also conceivable, as is also an additional console or device to which both toggle levers are fastened.

It is thereby made possible to move both brake calipers with their respective toggle levers synchronously and to distribute the forces that act through the toggle levers on the brake calipers uniformly on the brake calipers. It is also possible to equip a caliper brake with a single spring accumulator which acts on the said point and jointly moves the toggle levers.

Preferably, the caliper brake can be held in the ready position by an actuating mechanism. Through triggering of the actuating mechanism, the caliper brake can be brought out of the ready position into the braking position. Preferably, an actuating mechanism of this type contains a triggering mechanism as well as a resetting mechanism. Triggering mechanism and resetting mechanism can be manufactured as separate assemblies.

A further aspect of the invention relates to a method for generating a press-on force in a caliper brake. Preferably, in a caliper brake as here described, a brake arm is brought from a ready position into a braking position. To generate the press-on force, the brake arm is deformed perpendicular to its length, preferably by up to 10%, particularly preferably by up to 7.5%, and particularly preferably by up to 5%, of its length. Preferably, the aforesaid deformation is so dimensioned that, when set to a minimum load, the brake arm is still deformed by at least 2% of its length perpendicular to its length.

Such a method enables a brake caliper to be embodied in such manner that, during the braking process, only a single actuating position is predefined and adopted. Furthermore, because of their easy adjustability, an actuating mechanism and a force accumulator for various braking forces can always remain identically dimensioned, or it is at least possible to retain the basic geometrical dimensions for different constructive sizes of caliper brakes.

A further aspect of the invention relates to an elevator device for a caliper brake, preferably for a caliper brake as here described. The caliper brake has at least a toggle lever and a force accumulator. The actuating mechanism has an actuating lever, which has a first base point and a first control point as well as, situated in between, a first force-output point to actuate the toggle lever. With its first base point, the actuating lever is in mechanical engagement with a brake housing and, with its first force-output point, the actuating lever is in mechanical engagement with the force accumulator.

An actuating device which is embodied in such manner enables the actuation of a caliper brake wherein a desired force reduction can be achieved through the embodiment of the actuating lever. The actuating device is preferably built into the caliper brake so that a complete caliper brake results. Self-evidently, the actuating device can also be embodied as a separate unit, which is then, in case of need, mounted on the caliper brake, or another brake, or connected therewith.

Preferably, at its first base point, by means of a compensating tension lever, the actuating lever is connected with the brake housing or a console. Alternatively, it is conceivable that, at a first force-output point, by means of a compensating tension lever, the actuating lever is connected with the force accumulator.

Alternatively, it is also conceivable that, provided in the actuating lever are elongated apertures or bearings, which only allow movement in a direction perpendicular to the direction of movement of the actuating lever.

This enables prevention of a jamming or deformation of the actuating mechanism. In particular, movements of the actuating lever perpendicular to the force can be compensated.

Preferably, the first base point of the actuating lever, as well as its first force-output point and its first control point, are arranged on the actuating lever in such manner that, between the first force-output point and the first control point, a lever ratio, and consequently a force ratio, of at least 1:2, and preferably of at least 1:3, prevails. Further force ratios are conceivable, which can be essentially freely chosen.

This enables the actuating lever to be actuated with a force that is substantially smaller than the actual force that is in the same ratio as the lever ratio.

Preferably, the actuating mechanism further contains a control lever, which has a second base point, a second control point, and, situated in between, a second force-output point. With its second force-output point, the control lever can be in mechanical engagement with the first control point of the actuating lever. With its second base point, the control lever is swivelably connected with the brake housing.

With a control lever that controls the actuating lever, a compact embodiment of the actuating mechanism is possible. An eccentric force input is also possible.

In the area of its second control point, the control lever can be in mechanical engagement with an actuating mechanism, and preferably with a triggering and resetting mechanism. The triggering mechanism is preferably electromagnetically actuatable and/or, in a preferred embodiment, operation of the resetting mechanism is motorized.

An electromagnetic triggering enables the rapid triggering of the mechanism. Through a motorized operation of the resetting mechanism it is possible to generate sufficiently large forces. In particular, a resetting mechanism of such type can be embodied as a spindle drive.

Preferably, the second base point, the second force-output point, and the second control point, are arranged on the actuating lever in such manner that, between the second force-output point and the second control point, a lever ratio of at least 1:2, and preferably at least 1:3, and particularly preferably of at least 1:4, prevails.

This makes it possible to hold, or move, the control lever with a holding force which is very small in relation to the braking force. The resetting force can be chosen correspondingly small. Such an embodiment consequently makes it possible for the control lever, or resetting mechanism, to be realized with very small dimensions and inexpensively.

Preferably, the control lever and the actuating lever are arranged in mutually inclined planes. Advantageously, the angle between the planes is ≥30°, preferably ≥45°, and particularly preferably the angle between the two planes is around 90°.

Consequently, an actuating mechanism can be constructed very compactly, in particular with a small constructive height.

From the first force-output point to the second control point, the entire actuating mechanism has a force ratio of at least 1.8 and preferably of at least 1:10.

This makes it possible to use for the resetting and/or triggering mechanism mechanical components which can have small dimensions.

A further aspect of the invention relates to an elevator system with at least one caliper brake as here described, which preferably has an actuating mechanism as here described.

Elevator systems can then be built into narrower hoistways, since such a caliper brake can be dimensioned correspondingly compact. Furthermore, such a caliper brake in an elevator system enables the elevator system to be embodied with relatively small triggering mechanisms.

The caliper brake with the corresponding actuating mechanism that is expounded here is preferably mounted, or arranged, on an elevator car of the elevator system. Preferably, a pair of such caliper brakes is used, which can interact with a corresponding guiderail pair of the elevator car In a safety application, the caliper brakes are preferably controlled by an electronic speed governor or, more generally, by a monitoring device. As soon as the monitoring device or the electronic speed governor detects a deviation of a movement, or of a state, of the elevator car, the triggering device of the caliper brake is released and the force accumulator can bring the caliper brake into action. The corresponding resetting mechanism can reload the force accumulator and thereby release the caliper brake. This resetting can be initialized manually, however, it can also take place automatically when, for example, it is detected that the elevator is functioning faultlessly.

The caliper brake can further be used also to stop the elevator car at a stop. In this case, for example, the resetting mechanism is also used to actuate the brake. In this case, when the elevator car has stopped at a stopping floor, the resetting mechanism slowly releases the force accumulator, for example, during a time period of around 5 seconds. After closure of the caliper brake, a drive of the elevator system can be switched current-free. In the presence of a travel command for the elevator system, the resetting mechanism can automatically release the caliper brake. By this means, the same brake can be used to halt the car under operational conditions as to stop the car rapidly in the event of a fault. In addition, through this slow release, and closure of the caliper brake, in particular, no impact sounds occur, which, at least in normal operation, is advantageous.

DESCRIPTION OF THE DRAWINGS

By reference to figures, which represent exemplary embodiments only, the invention is explained in greater detail below. Shown are in.

DETAILED DESCRIPTION

Figure 1:
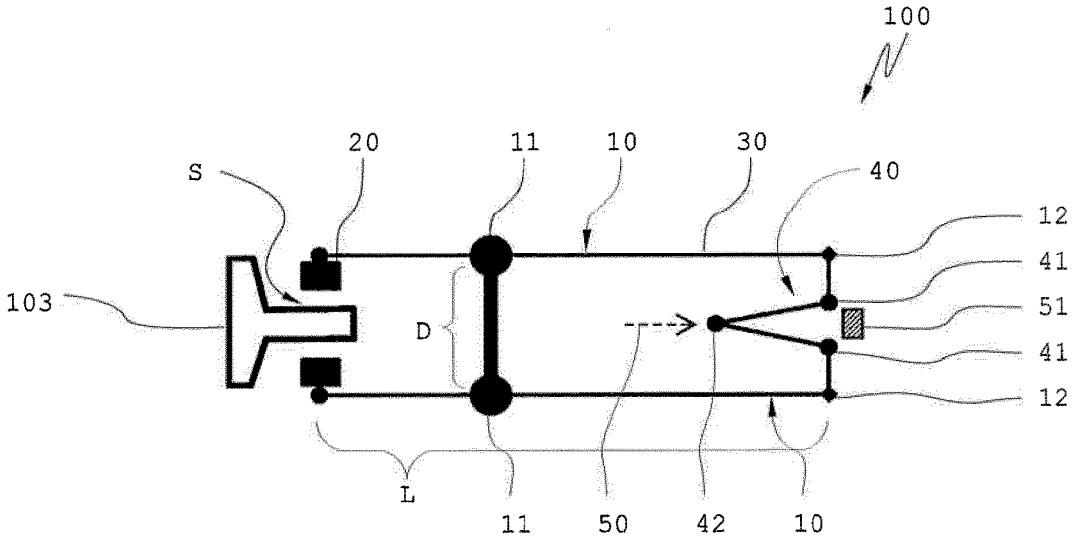
FIG. 1: a diagrammatic representation of a caliper brake according to the invention in a ready position.

FIG. 1 shows a diagrammatic representation of a caliper brake according to the invention 100 in a ready position. The caliper brake 100 has two brake calipers 10, which each have a fulcrum 11. The fulcrum 11 is connected with a brake housing (not shown here). The two fulcrums 11 of the brake calipers 10 are mutually separated by a distance D. Here, the two brake calipers 10 are shown essentially parallel and in a ready position. The brake calipers 10 have, at one end, brake pads 20 and, at the other end, a pivot point 12. Situated between fulcrum 11 and pivot point 12 is a brake arm 30. Situated at the pivot point 12 is a toggle-lever fulcrum 41, which is connected with a toggle lever 40. Shown diagrammatically is a stop 51. The brake calipers 10 have a length L. Between the two brake pads 20 of the brake calipers 10 is a guiderail 103 of an elevator. On both sides of the guiderail 103, between the guiderail 103 and the brake pad 20, is an air gap S. Shown diagrammatically in FIG. 1 as a dashed arrow is a force accumulator 50. The force that is generated by the force accumulator 50 acts on the toggle lever 40 at a toggle-lever input point 42 of the toggle lever 40.

Figure 2:
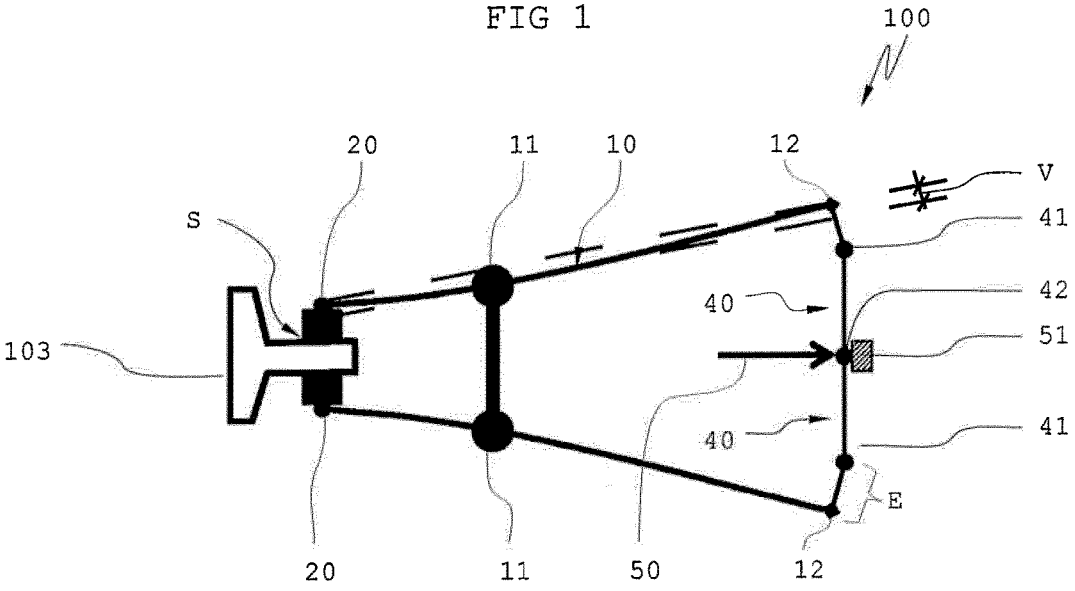
FIG. 2: a diagrammatic representation of the caliper brake from FIG. 1 in a braking position.

FIG. 2 shows a diagrammatic representation of the caliper brake 100 in a braking position. Through the force accumulator 50, the force-input point 42 was moved in the direction of the arrow towards the stop 51. The toggle-lever pivot points 41 and the force-input point 42 briefly formed a line in which the system is in an unstable position. The unstable position represents the dead point of the system. Subsequently, the force-input point 42 was moved further in the direction of the arrow as far as the stop, in other words, pushed slightly beyond the dead point. The two toggle levers 40 form an angle. Consequently, the caliper brake 100 remains in this position. The brake pads 20 rest against the guiderail 103. The air gap S is closed. The brake caliper 10 was flexed by the dimension V. Here, the dimension V is defined by the two end-points of the brake caliper and their maximum flexure. Through this flexure, with the brake calipers 10 a force is exerted on the guiderail 103. Because here the fulcrums 11 are fixed, the force must be changed by adjustment of the distance E between pivot point 12 and toggle-lever pivot point 41.

Figure 3:
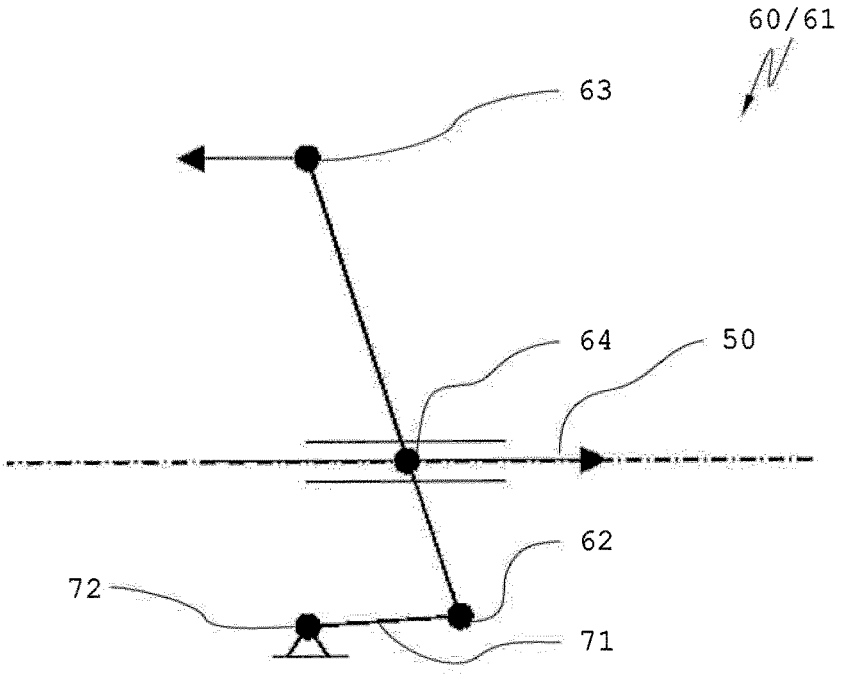
FIG. 3: a diagrammatic representation of an actuating lever.

FIG. 3 shows an actuating lever 61 of an actuating mechanism 60. With a base point 62, through a compensating tension lever 71, the actuating lever 61 is connected with a connecting point 72, which is situated on the brake housing (not shown here). Situated in the lower third of the actuating lever 61 is the force-output point 64, which is in mechanical engagement with the force-input point 42 of the toggle lever 40 (FIG. 1 or 2). Situated at the free end of the actuating lever 61 is a control point 63, through which the actuating lever 61 can be moved or controlled.

Figure 4:
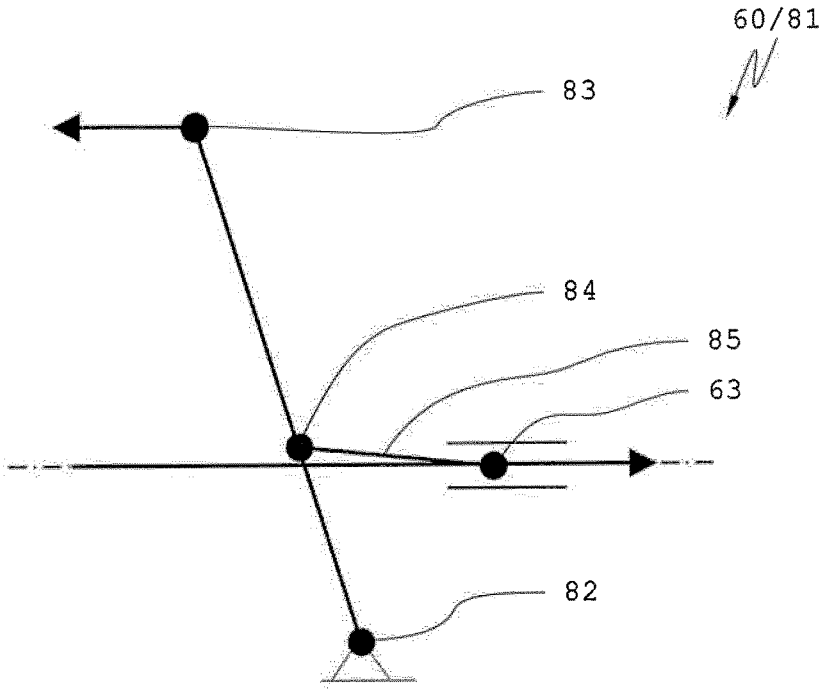
FIG. 4: a diagrammatic representation of a control lever.

FIG. 4 shows an actuating lever 81 of the actuating mechanism 60. The control lever 81 is fastened to the brake housing with a base point 82. Situated in the lower third of the actuating lever 81 is a force-output point 84, which, through a second compensating tension lever 85, is connected with the control point 63 of the actuating lever 61 (FIG. 3). The control lever 81 has a control point 83 through which the control lever 81 can be moved.

Figure 5:
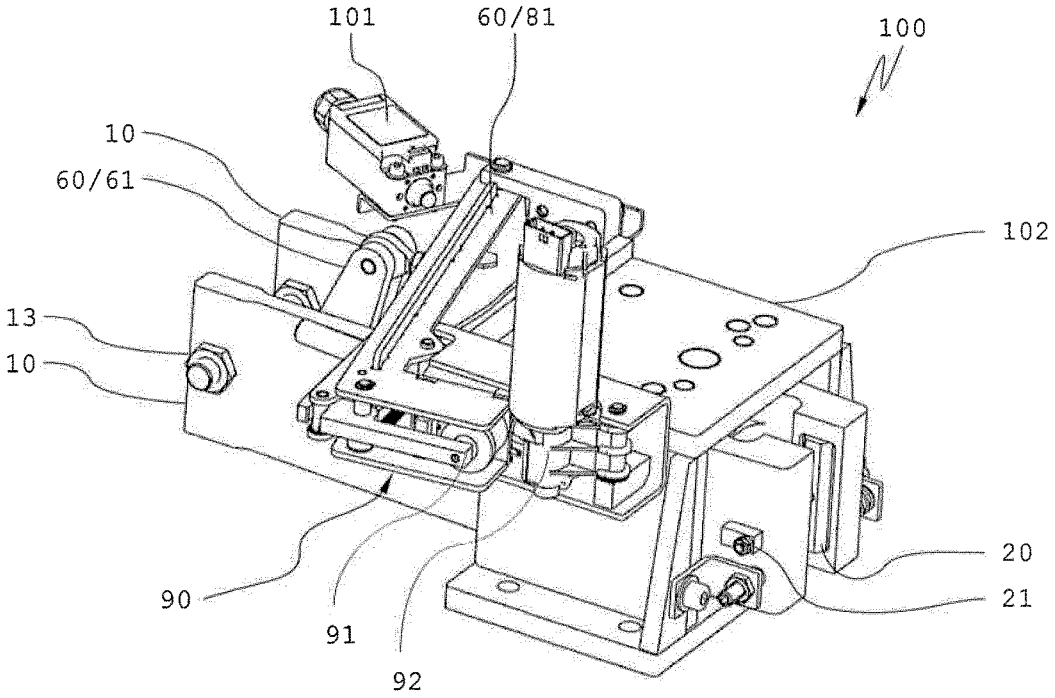
FIG. 5: a perspective view of a caliper brake according to the invention.

FIG. 5 shows an embodiment of a caliper brake 100 according to the invention in a perspective view. The caliper brake 100 has a brake housing 102. Situated inside the brake housing 102 are two brake calipers 10. Each of the brake calipers 10 has, at one end, a brake pad 20 and, at the other end, an adjustment screw 13. The caliper brake 100 has a limit switch 101 which can be actuated through the control lever 81, which is in mechanical engagement with the actuating lever 61. Also to be seen is a triggering, or resetting, mechanism 90, which has a triggering mechanism 91 and a resetting mechanism 92. The triggering or resetting mechanism 90 is in mechanical engagement with the control lever 81.

Figure 6:
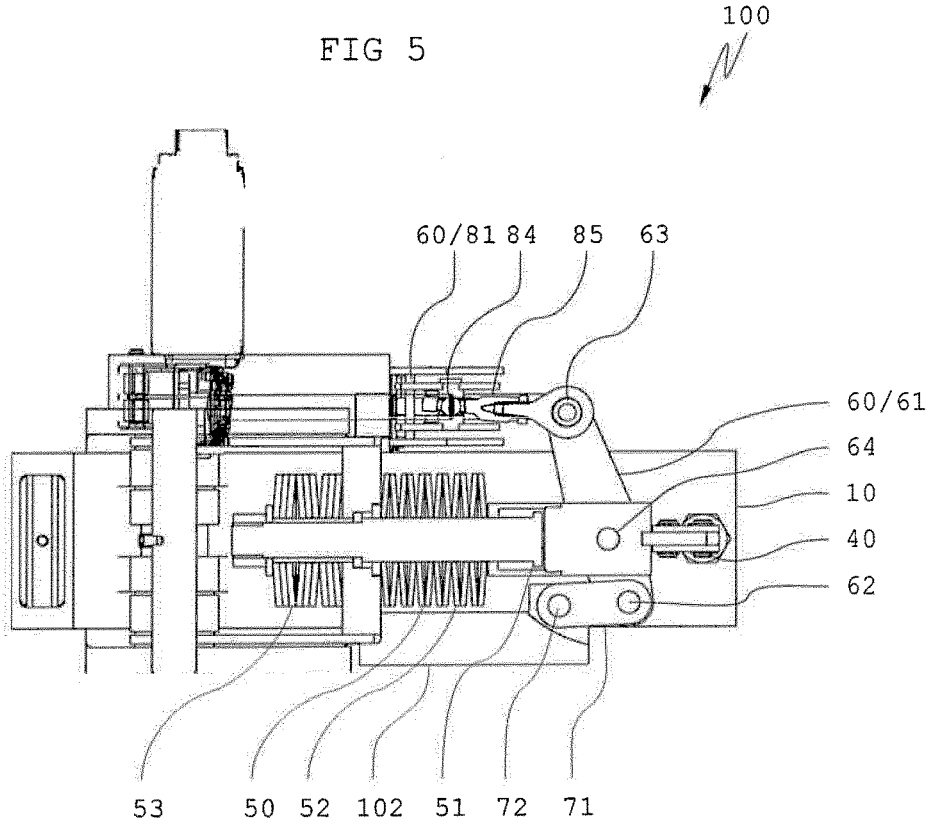
FIG. 6: a side view of the caliper brake of FIG. 5.

FIG. 6 shows the caliper brake 100 of FIG. 5 in a cross-sectional view of a plane midway between the brake calipers 10. Situated centrally is a force accumulator 50 which, through the force-output point 64 of the actuating lever 61, is joined with the toggle lever 40. In the example, the force accumulator consists essentially of disk springs which are assembled into a compression spring 52. A movement of the force-output point 64 is limited by the stop 51. As soon as the compression springs are decompressed as far as the stop 51, an impact which occurs is absorbed by the stop-buffer 53, so that an overloading of the material is avoided. Through its base point 61, with a compensating tension lever 71 the actuating lever 61 is fastened to a connecting point 72 on the brake housing 102. Furthermore, with its control point 63 and a second compensating lever 85, the actuating lever 61 is connected with the force-output point 84 of the control lever 81.

Figure 7:
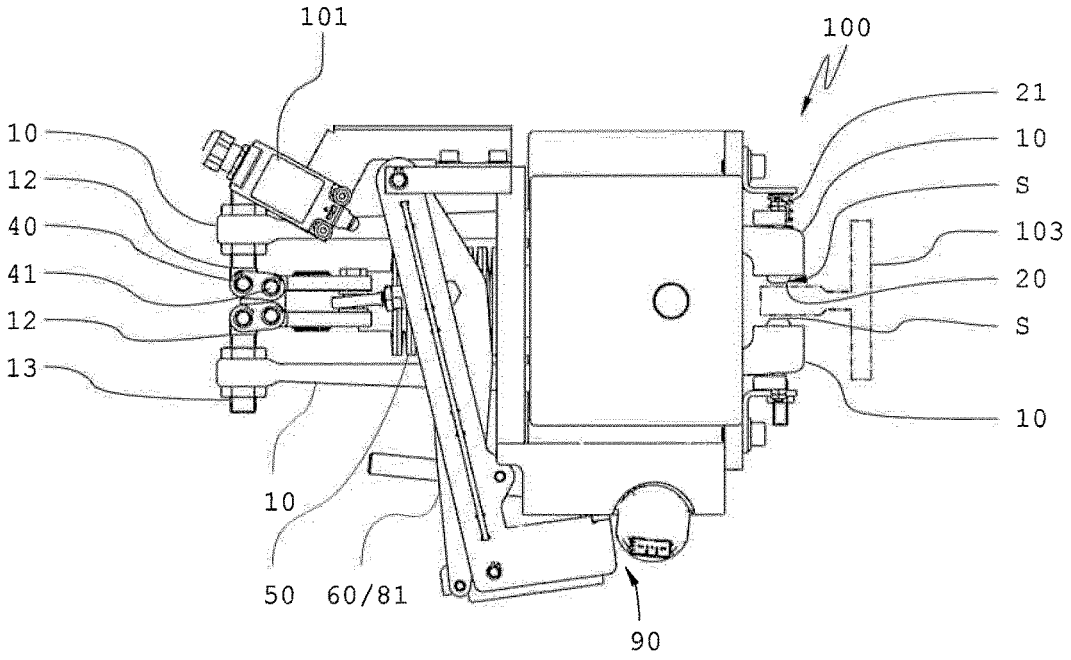
FIG. 7: a plan view of the caliper brake of FIG. 5 in the ready position.

FIG. 7 shows the caliper brake of FIG. 5 in a plan view. The brake calipers 10 are arranged on both sides of a guiderail 103 and have an air gap S to the guiderail 103. The caliper brake 100 is in a ready position. The toggle levers 40 are flexed towards the force accumulator 50 and their toggle-lever pivot points 41 are situated left of an imaginary line between the pivot points 12 of the brake calipers 10. Situated in the area of the pivot points 12 of the brake calipers 10 are adjustment screws 13 for the purpose of adjusting the braking force. The limit switch 101 is not engaged. The control lever 81 is also in a ready position and is held in this position by a triggering and resetting mechanism 90.

Figure 8:
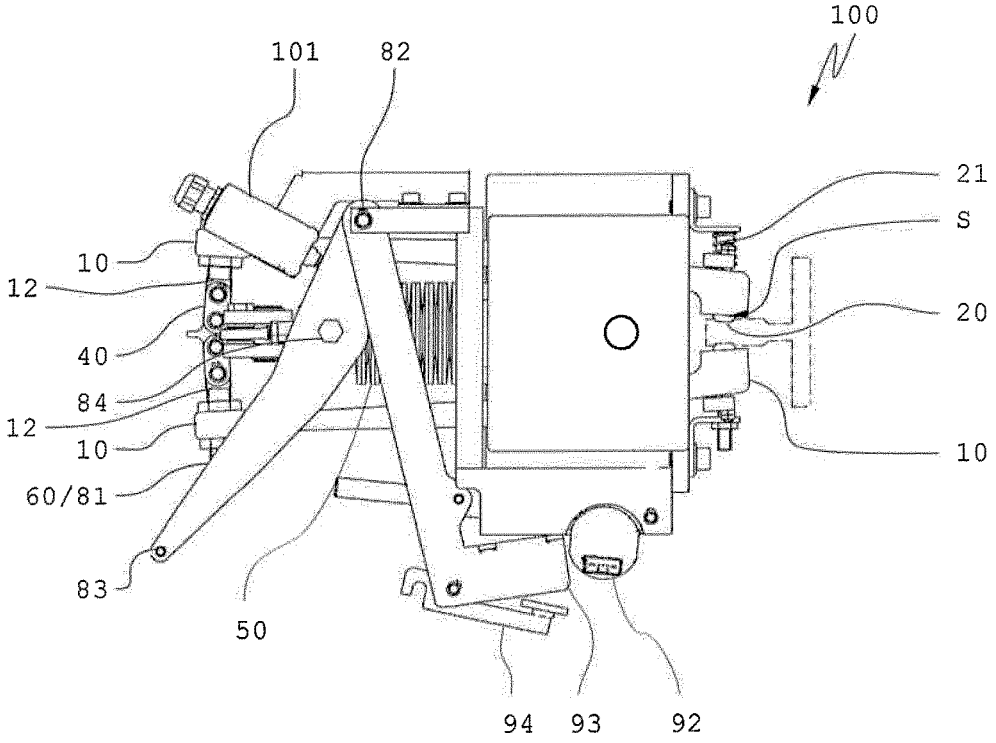
FIG. 8: the caliper brake of FIG. 7 in a braking position.

FIG. 8 shows the caliper brake 100 of FIG. 7 in the braking position. The toggle levers 40 are overextended and are situated in a dead-point position to the right of the imaginary line between the pivot points 12 of the brake calipers 10. The air gap S between the brake calipers 10 and the guide rail 103 is closed. The control lever 81 is also situated in the braking position. In order to arrive at the braking position, the control point 83 was released and, at its force-output point 84, the control lever 81 was deflected in the direction of the force of the force accumulator 50. The limit switch 101 is engaged by the actuating lever 81. The brake plates 20 are elastic and connected with the brake caliper 10 by means of a compensating spring 21. Hence, the brake pad 20 can ideally adapt to the braking surface of the guide rail so that no edge-pressures arise on the brake plate.

To release the caliper brake 100 from the braking position and to return the control lever 81 to the ready position, the resetting mechanism, which here is embodied as a spindle motor 92, is activated. To retrieve the control lever 81, by means of the spindle motor 92 a resetting lever 93 is moved in the direction of the control lever 81. A latch 94 on the resetting lever 93 engages in an axle at the control point of the control lever 81. After its engagement, the hook is held in a position relative to the resetting lever (as shown in FIG. 7) by means of an electromagnet (not shown here). Thereafter, the spindle motor 92 moves back to its original position, thereby releasing the caliper brake and compressing the force accumulator 50.

The exemplary embodiment that is shown is variable. So, for example, the two fulcrums 11 of the two brake calipers 10 can be combined into one central fulcrum. Instead of a resetting by means of spindle motor, a pneumatic, or a hydraulic, resetting device can be used or, with corresponding design, a solenoid or a rack-and-pinon drive can be used.

The brake calipers can also consist of a layered sheet-metal assembly, preferably a spring-steel assembly.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A caliper brake for an elevator system including at least one brake caliper comprising:

a brake pad; and a brake arm having the brake pad positioned at one end of the brake arm, a pivot point at another end of the brake arm and a fulcrum situated between the ends of the brake arm wherein the brake caliper is adapted to be swiveled between a ready position and a braking position, and wherein the brake arm is configured to provide a flexural deformation perpendicular to a length of the brake arm when a force is applied to the pivot point to swivel the brake caliper to the braking position.

2. The caliper brake according to claim 1 wherein the brake arm is formed at least partly as a leaf spring.

3. The caliper brake according to claim 1 wherein the brake caliper is in mechanical engagement with a brake housing.

4. The caliper brake according to claim 1 wherein a press-on force of the brake pad engaged on a guiderail when the brake arm is in the braking position is adjustable.

5. The caliper brake according to claim 4 wherein the press-on force is adjustable by an adjusting screw situated at the another end of the brake arm.

6. The caliper brake according to claim 1 wherein a degree of deformation of the brake arm is adjustable by adjustment of an air gap between the brake pad and an adjacent guiderail.

7. The caliper brake according to claim 1 including a toggle lever for moving the brake arm from the ready position into the braking position, and wherein, in the braking position, the toggle lever is in a stop position, beyond a dead point of the toggle lever, engaging a stop.

8. The caliper brake according to claim 7 wherein the toggle lever has a force-input point that is mechanically engaged with a force accumulator, wherein, in the braking position, the position of the toggle lever is controlled by the force accumulator and the stop.

9. The caliper brake according to claim 8 wherein the force accumulator is a spring assembly.

10. The caliper brake according to claim 8 wherein the stop limits a stroke of the force accumulator and the force accumulator includes a stop buffer for absorbing an impact when the stop is engaged.

11. The caliper brake according to claim 7 characterized in the caliper brake includes two of the brake caliper, each of the brake calipers has a separate one of the toggle lever, and the toggle levers are mutually connected.

12. The caliper brake claim 1 including an actuating mechanism for holding the caliper brake in the ready position and, through triggering of the actuating mechanism, the caliper brake is brought out of the ready position into the braking position.

13. The caliper brake according to claim 1 including an actuating mechanism having an actuating lever with a first base point, a first control point, and a first force-output point situated between the first base point and the first control point for actuating a toggle lever, wherein through the first base point, the actuating lever is in mechanical engagement with a brake housing, and wherein through the first force-output point, the actuating lever is in mechanical engagement with a force accumulator for swiveling the brake caliper.

14. The caliper brake according to claim 13 wherein at the first base point, the actuating lever is connected by a compensating tension lever with the brake housing, or at the first force-output point, the actuating lever is connected by a compensating-tension lever with the force accumulator.

15. The caliper brake according to claim 13 wherein the first force-output point and the first control point are arranged on the actuating lever relative to the first base point, such that a ratio of lengths from the first base point is in a range of 1:2 to 1:3.

16. The caliper brake according to claim 13 including a control lever having a second force-output point situated between a second base point and a second control point, wherein the control lever through the second force-output point is in mechanical engagement with the first control point of the actuating lever, and through the second base point is swivelably connected with the brake housing.

17. The caliper brake according to claim 16 wherein proximate the second control point the control lever is in mechanical engagement with a triggering mechanism and a resetting mechanism of the actuating mechanism wherein the triggering mechanism is electromagnetically actuatable and operation of the resetting mechanism is motorized.

18. The caliper brake according claim 16 wherein the second force-output point and the second control point are arranged on the control lever relative to the second base point such that a ratio of lengths from the second base point is in a range of 1:2 to 1:4.

19. The caliper brake according to claim 16 wherein the control lever and the actuating lever are arranged in mutually inclined planes, wherein an angle between the planes is greater than or equal to 30°.

20. An elevator system having an elevator car movable along a guiderail comprising:

a caliper brake attached to the elevator car and having a pair of brake calipers adapted to be swiveled between a ready position and a braking position, each of the brake calipers including, a brake pad for engaging the guiderail in the braking position; and a brake arm having the brake pad positioned at one end of the brake arm, a pivot point at another end of the brake arm and a fulcrum situated between the ends of the brake arm wherein the brake arm is configured to provide a flexural deformation perpendicular to a length of the brake arm when a force is applied to the pivot point to swivel the brake caliper to the braking position.

21. A method for generating a press-on force in a caliper brake engaging a guiderail comprising the steps of:

bringing a brake arm from a ready position into a braking position to generate the press-on force; and deforming the brake arm perpendicular to a length of the brake arm in a range of 10% to 2% of the length to generate the press-on force.

* * * * *